US006142747A

United States Patent [19]

Rosenau et al.

[11] Patent Number: 6,142,747

[45] Date of Patent: Nov. 7, 2000

[54] FUEL PUMP ASSEMBLY

[75] Inventors: Bernd Rosenau, Tamm; Gerd Loesch; Markus Rueckle, both of Stuttgart, all of Germany

[73] Assignee: Robert Bosch GmbH, Stuttgart, Germany

[21] Appl. No.: 09/266,923

[22] Filed: Mar. 12, 1999

[30] Foreign Application Priority Data

Mar. 13, 1998 [DE] Germany ..... 198 10 867

[51] Int. Cl.[7] ..... F04B 3/00; F04B 5/00; F04B 25/00

[52] U.S. Cl. ..... 417/251; 417/286; 123/446

[58] Field of Search ..... 123/447, 446; 417/199.2, 45, 251, 252, 428, 218, 286; 137/487.5

[56] References Cited

U.S. PATENT DOCUMENTS

| | | | |
|---|---|---|---|
| 3,919,989 | 11/1975 | Jarrett et al. | 123/447 |
| 4,187,822 | 2/1980 | Craven et al. . | |
| 4,253,802 | 3/1981 | Glikin | 417/199.2 |
| 4,260,333 | 4/1981 | Schillinger | 417/45 |
| 4,377,139 | 3/1983 | Jarrett et al. . | |
| 4,738,596 | 4/1988 | Abinett et al. | 417/252 |
| 5,064,357 | 11/1991 | Smith | 417/428 |
| 5,180,290 | 1/1993 | Green | 417/218 |
| 5,404,855 | 4/1995 | Yen et al. | 123/446 |
| 5,927,322 | 7/1999 | Rosenau | 137/487.5 |
| 5,971,718 | 10/1999 | Krueger et al. | 417/286 |
| 5,996,556 | 12/1999 | Klinger et al. | 123/446 |

FOREIGN PATENT DOCUMENTS

| | | |
|---|---|---|
| 0299337 | 1/1989 | European Pat. Off. . |
| 1583011 | 9/1977 | United Kingdom . |
| 2132700 | 7/1984 | United Kingdom . |
| 2296040 | 6/1996 | United Kingdom . |
| WO 94/27039 | 11/1994 | WIPO . |
| WO 94/27041 | 11/1994 | WIPO . |

*Primary Examiner*—Teresa Walberg
*Assistant Examiner*—Leonid Fastovsky
*Attorney, Agent, or Firm*—Ronald E. Greigg; Edwin E. Greigg

[57] ABSTRACT

The invention relates to a fuel pump assembly having a low-pressure region (ND) with at least one low-pressure pump-and a high-pressure region (HD) with at least one regulated-quantity high-pressure pump, which pumps a quantity of fuel required to compensate for the quantitative balance in the high-pressure region, the quantity regulation being effected via a metering unit which is disposed between the low-pressure pump and the high-pressure pump. In order, by simple and sturdy means with high availability and a long service life, to prevent the fuel quantity in correctly pumped by the metering unit at certain operating points from reaching the high-pressure region, the invention proposes that the pumping flow of the low-pressure pump is greater than the pumping flow of the high-pressure pump; that a fuel return line branches off between the metering unit and the high-pressure pump and discharges into the inlet of the low-pressure pump; and that a control element is disposed in the return line.

40 Claims, 3 Drawing Sheets

FUEL PUMP ASSEMBLY

BACKGROUND OF THE INVENTION

The present invention relates to a fuel pump assembly, having a low-pressure region with at least one low-pressure pump and a high-pressure region with at least one regulated-quantity high-pressure pump, which pumps a quantity of fuel required to compensate for the quantitative balance in the high-pressure region, the quantity regulation being effected via a metering unit which is disposed between the low-pressure pump and the high-pressure pump.

Such fuel pump assemblies have long been known in the prior art. They are used predominantly in automotive engineering for delivering fuel to direct-injected engines. By regulating the quantity of fuel furnished by the high-pressure pump, greater efficiency of the fuel pump assembly is obtained and the operating temperature is reduced.

Because of the common rail injection technique that has come into use in recent years, such fuel pump assemblies have become widespread. In the common rail technique, a high-pressure fuel pump, a distributor line, and electromagnetic injection valves replace the conventional fuel injection pump and injection valves. Thus not only can the injection pump be varied entirely as needed between 250 and 1600 bar, but the instant and course of injection can be varied as desired by the specification of the electronic engine controller. The common rail injection technique provides for a reduction in fuel consumption and pollutant emissions as well as noise abatement, while at the same time providing better power.

The fuel pump assemblies known from the prior art have the disadvantage, however, that at certain operating points, and particularly in so-called zero pumping, when the high-pressure pump requires no fuel quantity and the metering unit is closed, a slight unintended pumping can still occur. Depending on how the metering unit functions, the unintended pumping is caused for instance by leakage or measurement errors on the part of the metering unit and can hardly be avoided despite major technological efforts to counteract it.

The unintentionally pumped fuel quantity irritates the high-pressure pump in the high-pressure region of the fuel pump assembly and is therefore, in the prior art, drawn from the high-pressure region again by suitable means, such as a pressure regulating valve. However, such pressure regulating valves are complicated in design, expensive to procure, and above all subject to major wear. As a consequence, the pressure regulating valves fail unpredictably, so that the availability of the entire fuel pump assembly, of the kind known in the prior art, is often unable to meet the high demands made in modern engine construction.

OBJECT AND SUMMARY OF THE INVENTION

The principal object of the invention is therefore to define the fuel pump assembly of the type defined at the outset, such that by simple and sturdy means, with high availability and a long service life, the fuel quantity unintentionally pumped by the low-pressure pump at certain operating points is prevented from reaching the high-pressure region.

To attain this object, the invention proposes that the pumping flow of the low-pressure pump is greater than the pumping flow of the high-pressure pump; that a fuel return line branches off between the metering unit and the high-pressure pump and discharges into the inlet of the low-pressure pump; and that a control element is disposed in the return line.

Because of the different-sized pumping flows of the low-pressure pump and the high-pressure pump, an overpressure is built up between the low-pressure pump and the metering unit. Despite the closed metering unit, a leakage flow is capable of flowing via the metering unit and undesirably reaching the high-pressure pump. Therefore according to the invention a return line branches off downstream of the metering unit, and through this line the unintentionally pumped fuel quantity can be carried away from the metering unit. The control element in the return line assures that on the one hand the high-pressure pump will not be supplied with fuel when the metering unit is closed, and on the other that the unintentionaly pumped quantity on the delivery side of the low-pressure pump will not be overly large under conditions of full pumping action; that is, in full pumping action conditions, the high-pressure pump will receive an adequate fuel quantity.

Because a pressure regulating unit, which is subject to wear, with a pressure regulating valve in the high-pressure region is omitted in the fuel pump assembly of the invention, substantially better efficiency is obtained than in conventional fuel pump assemblies with pressure regulating valves. Because there is less wear, the fuel pump assembly of the invention also operates at substantially lower operating temperatures. Furthermore, the fuel pump assembly is simple and sturdy in construction and has high availability and a long service life.

In an advantageous refinement of the invention, it is proposed that the control element is embodied as a switch element. By means of such a switch element, the fuel return line can be opened only at certain operating points in which it is known that unintended pumping can occur. Otherwise, the return line is blocked, and all the fuel pumped by the low-pressure pump reaches the high-pressure pump.

Unintended fuel pumping occurs particularly in zero pumping; at other operating points, as a rule there is hardly ever any unintentionally pumped fuel quantity. In order for the unintentionally pumped fuel quantity to be diverted only in the operating point of zero pumping, it suffices for the switch element advantageously to be embodied as a two-point switch element. This element is designed such that it opens the return line only during zero pumping, while in all other operating points it blocks the return line. This embodiment is especially simple and sturdy in construction and nevertheless assures reliable return of virtually all the unintentionally pumped fuel.

Instead of being embodied as a switch element, the control element can alternatively also be embodied as a throttle element. Such a throttle element is designed for the particular application, so that in all the necessary operating points a genuine zero pumping state will be assured, or in other words so that at the various operating points, a complete return of all the unintentionally pumped fuel will be assured. In designing the throttle element, care should be taken that the fuel quantity demanded is always present at the high-pressure pump, so that there is no major loss of efficiency of the fuel pump assembly.

The fuel pump assembly of the invention can be used to supply fuel to arbitrary internal combustion engines. However, the advantages of the fuel pump assembly of the invention are especially important if, in an advantageous refinement of the invention, the fuel pump assembly can be used in internal combustion engines with direct injection, especially if the direction injection operates by the common rail technique. By the use of the fuel pump assembly of the invention in internal combustion engines of motor vehicles, their fuel consumption and pollutant emissions can be reduced still further, and decisively.

As overload protection for the low-pressure region of the fuel pump assembly of the invention, in another advantageous refinement of the invention, an overflow line branches off from the outlet of the low-pressure pump and discharges into the inlet of the low-pressure pump. An overflow valve is disposed in the overflow line, which opens as soon as the pressure applied exceeds a predetermined value and thus assures pressure equalization in the low-pressure region.

It has proved to be particularly advantageous to combine the metering unit, the control element and the overflow valve into a metering unit assembly. Such an individual metering unit assembly is substantially easier to handle than many individual components that have to be connected to one another via connecting lines.

Advantageously, the metering unit assembly comprises a metal block in which the individual components, that is, the metering unit, control element, and overflow valve, are embodied as integral components. The connecting lines between the individual components are also embodied in the metal block in the form of connecting line conduits. A metering unit assembly embodied in this way can be produced simply and economically. Furthermore, it is especially sturdy and can withstand very high pressures.

In an advantageous refinement of the invention, for the sake of simpler and more-economical production of the metering unit assembly, it is also proposed that the connecting line conduits be made in the form of bores in the metal block which are closable with respect to the outside of the metal block. For closing the bores, closure screws with or without sealing rings can be screwed into the bores from outside, or closure balls of metal or plastic can be introduced into the bores from outside in clamping fashion.

By means of suitable connecting lines, the metering unit assembly can be incorporated into the fuel pump assembly. To that end, the metering unit assembly advantageously has an inlet opening, an outlet opening, a return opening, and an overflow opening. Via the inlet opening, fuel from a fuel tank is brought via a low-pressure pump to the inlet of the metering unit in the metering unit assembly. Via the outlet opening, the fuel quantity furnished by the metering unit is brought to the inlet of the high-pressure pump. Both the return opening and the overflow opening communicate with the inlet of the low-pressure pump. Via these two openings, the diverted, unintentionally pumped fuel from the return line, or fuel from the overflow valve in the overflow line, is delivered back to the low-pressure pump.

In an advantageous refinement of the invention, the return opening and the overflow opening are embodied as a combined return overflow opening. This means that the return line and the overflow line already unite in the metering unit assembly and then extend jointly out of it via the combined opening and communicate with the inlet of the low-pressure pump by means of a connecting line.

In another advantageous refinement of the invention, it is proposed that the metering unit has a cylindrical hollow chamber in which a piston is disposed so as to be displaceable along its longitudinal axis. By displacing the piston in the hollow chamber, the metering unit is adjusted.

Advantageously, the metering unit has a proportional lifting magnet for adjusting the metering unit. To that end, the piston of the metering unit is connected to the armature of the lifting magnet. A metering unit embodied in this way is small and sturdy and has extremely short response times.

Particular advantages in handling the metering unit assembly are obtained if the lifting magnet is flanged to the metering unit assembly. For simple, fast fastening of the lifting magnet to the metering unit assembly, it is proposed that the lifting magnet be secured to the metering unit assembly by fastening screws.

In a further advantageous refinement of the invention, the metering unit assembly is integrated with the low-pressure pump, and with it forms a low-pressure pump assembly. Such a low-pressure pump assembly, in which all the essential components of the low-pressure region of a fuel pump assembly are integrated, is especially easy to handle.

Another advantageous refinement of the fuel pump assembly of the invention proposes that the overflow valve has a valve cone, which is pressed against a valve seat by means of a compression spring, and the tension of the compression spring is adjustable from outside the metering unit assembly by means of an adjusting screw that acts axially on the compression spring.

The invention will be better understood and further objects and advantages thereof will become more apparent from the ensuing detailed description of preferred embodiments taken in conjunction with the drawings.

DESCRIPTION OF THE PREFERRED EMBODIMENTS

Figure 1:
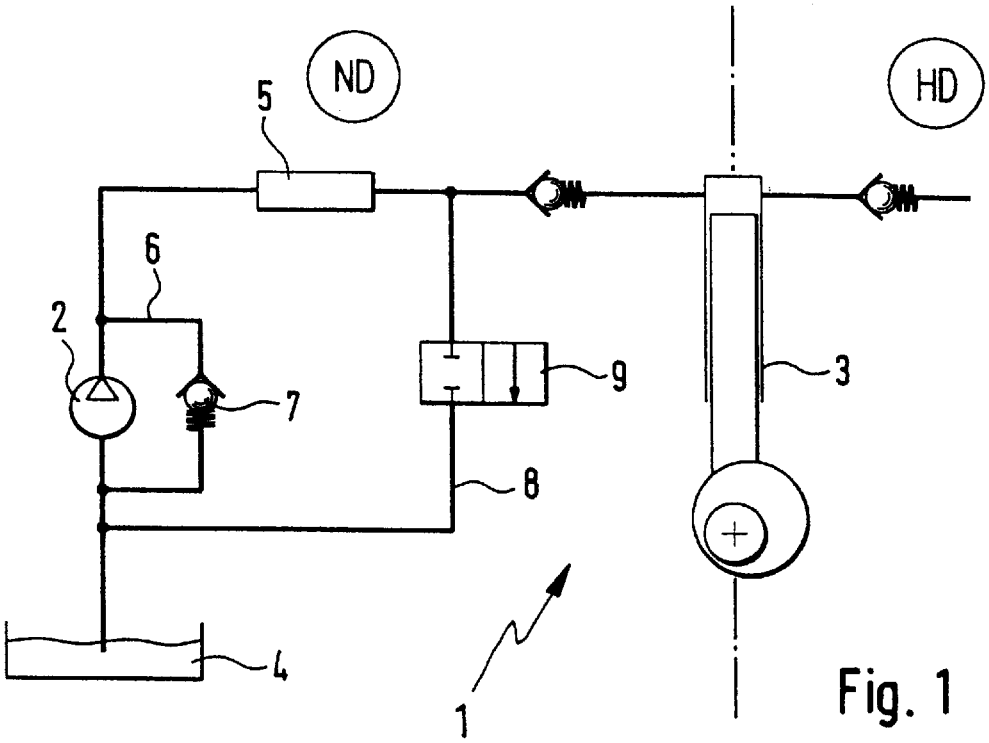
FIG. 1 is a schematic elevation view of a fuel pump assembly of the invention in a first embodiment.

In FIG. 1, a fuel pump assembly of the invention is identified overall, in a first embodiment, by reference numeral 1. The fuel pump assembly 1 has a low-pressure region ND with a low-pressure pump 2 and a high-pressure region HD with a high-pressure pump 3. The low-pressure pump 2 is embodied as a gear wheel pump, vane cell pump or piston pump, and the high-pressure pump 3 is embodied as a piston pump. The low-pressure pump 2 pumps fuel out of a fuel tank 4 to the high-pressure pump 3. The high-pressure pump 3 then pumps the fuel, at a very high pressure, to injection valves of an internal combustion engine (not shown).

In the low-pressure region, a metering unit 5 is disposed between the low-pressure pump 2 and the high-pressure pump 3. It measures the fuel quantity required in the high-pressure region and regulates the high-pressure pump 3 in such a way that it pumps the fuel quantity required to compensate for the quantity balance in the high-pressure region. By means of this kind of regulated-quantity high-pressure pump 3, the operating temperature in the region of the fuel pump assembly 1 can be reduced.

For overload protection of the low-pressure region of the fuel pump assembly 1, an overflow line 6 branches off from the as outlet of the low-pressure pump 2 and discharges into the inlet of the low-pressure pump 2. An overflow valve 7 is disposed in the overflow line 6 and opens as soon as the applied pressure exceeds a predetermined value, and thus assures a pressure equalization in the low-pressure region.

At certain operating points of the fuel pump assembly 1, particularly in so-called zero pumping, where in other words the high-pressure pump 3 does not require any fuel quantity from the low-pressure pump 2, a slight unintended pumping can occur even though the metering unit is closed. Depending on the construction and mode of operation of the metering unit 5, the unintended pumping is caused for instance by leakage or measurement errors on the part of the metering unit 5.

To prevent these troublesome unintentionally pumped fuel quantities from reaching the high-pressure region, a fuel return line 8 branches off between the metering unit 5 and the high-pressure pump 3 and discharges into the inlet of the low-pressure pump 2.

Because the pumping flows of the low-pressure pump 2 and the high-pressure pump 3 differ, an overpressure develops between the low-pressure pump 2 and the metering unit 5, and a negative pressure develops in the return line 8. By means of this negative pressure, the unintentionally pumped fuel quantity is diverted from the metering unit via the return line 8 to the inlet of the low-pressure pump 2.

A control element embodied as a two-point switch element 9 is disposed in the return line 8. This control element assures that on the one hand, when the metering unit 5 is closed, the high-pressure pump 3 will not be supplied with fuel, and on the other that the unintentionally pumped quantity on the other delivery side of the low-pressure pump 2 will not become too great when there is full pump action. The two-point switch element 9 controls the flow quantity of diverted fuel in such a way that at a certain operating point, preferably zero pumping, the return line 8 is opened, while outside this operating point the return line 8 is blocked. With the return line 8 open, reliable diversion of the unintentionally pumped fuel is assured. With the return line 8 blocked, all the fuel quantity pumped by the low-pressure pump 2 is available at the high-pressure pump 3.

Figure 2:
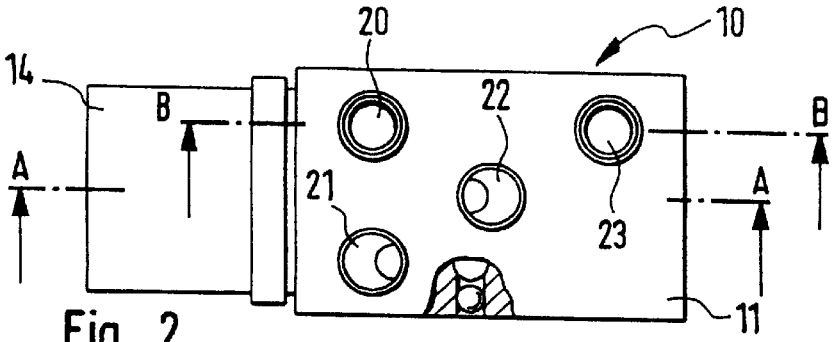
FIG. 2, partly in section, shows a metering unit assembly of the fuel pump assembly of the invention of FIG. 1.
Figure 3:
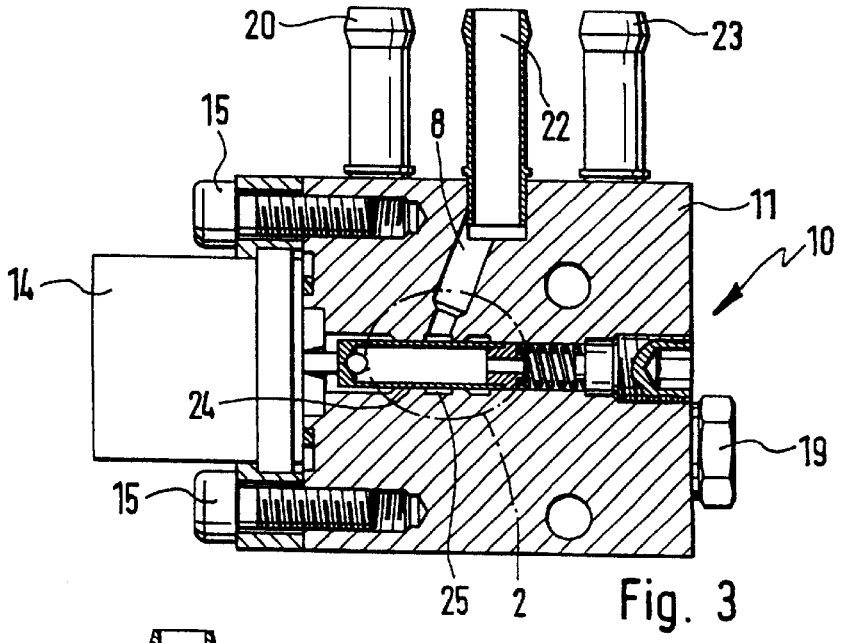
FIG. 3, in a sectional view taken along the line A—A, shows the metering unit assembly of FIG. 2.
Figure 4:
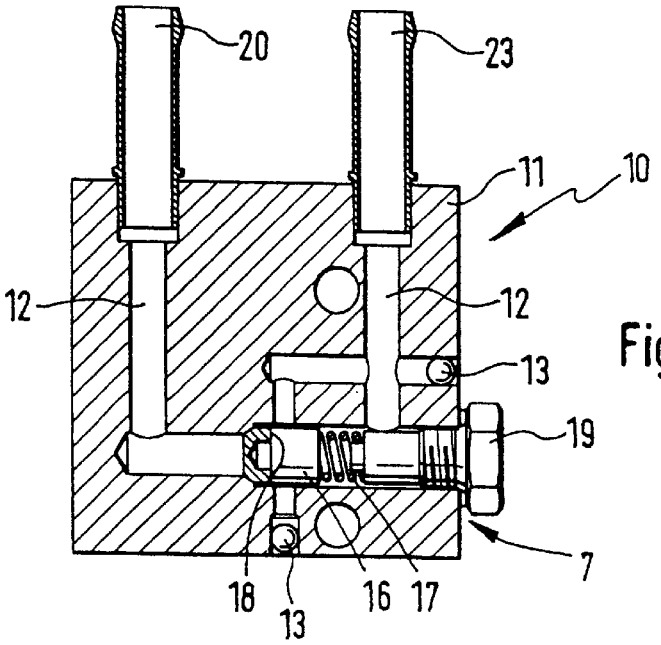
FIG. 4, in a sectional view taken along the line B—B, shows the metering unit assembly of FIG. 2.

In FIGS. 2–4, the metering unit 5, two-point switch element 9 and overflow valve 7 are combined into a metering unit assembly 10. The metering unit assembly 10 is embodied as a metal block 11, in which the metering unit 5, the two-point switch element 9, the overflow valve 7 and connecting line conduits 12 are embodied as integral components. The connecting line conduits 12 are made in the form of bores in the metal block 11. The bores can be closed with respect to the outside of the metal block 11. For closing the bores, closure balls 13 of metal are used.

The metering unit 5 has a cylindrical hollow chamber, in which a piston 24 is supported (see FIG. 3) so as to be displaceable along its longitudinal axis. Displacing the piston 24 in the hollow chamber adjusts the metering unit 5. The metering unit 5 has a proportional lifting magnet 14 for adjusting the metering unit 5. To that end, the piston 24 of the metering unit 5 is connected to the armature of the lifting magnet 14. The lifting magnet, 14 is flanged to the metal block 11 by means of fastening screws 15.

The overflow valve 7 has a valve cone 16, which is pressed onto a valve seat 18 (see FIG. 4) by means of a compression spring 17. The tension of the compression spring 17 can be adjusted from outside the metal block 11 by means of an adjusting screw 19 that acts axially on the compression spring.

To enable incorporating the metering unit assembly 10 into the fuel pump assembly 1, the metering unit assembly 10 has an inlet opening 20, an outlet opening 21, a return opening 22, and an overflow opening 23. Via the inlet opening 20, fuel from the fuel tank 4 is brought via the low-pressure pump 2 to the inlet of the metering unit 5 in the metering unit assembly 10. Via the outlet opening 21, the fuel quantity furnished by the metering unit 5 is brought to the inlet of the high-pressure pump 3. Both the return opening 22 and the overflow opening 23 communicate with the inlet of the low-pressure pump 2. Via these two openings 22, 23, the diverted, unintentionally pumped fuel from the return line 8, or fuel from the overflow valve 7 in the overflow line 6, is returned to the low-pressure pump 2. To facilitate the incorporation into the fuel pump assembly 1 by means of connecting lines (not shown), stubs to which the connecting lines can easily be secured are embodied at the openings 20, 21, 22, 23.

In the event of zero pumping, the piston 24 of the metering unit 5 is at a standstill. The unintentionally pumped fuel quantity, for instance a leakage flow from the metering unit 5, collects in an annular conduit 25 formed in the wall of the cylindrical hollow chamber of the metering unit 5. To prevent unintended pumping of this leakage flow into the high-pressure pump 3, the leakage flow is diverted via the return line 8. Since the pumping flow from the low-pressure pump 2 is greater than the pumping flow from the high-pressure pump 3, an overpressure develops between the low-pressure pump 2 and the metering unit 5, and a negative pressure forms in the return line 8 connected to the inlet of the low-pressure pump 2. By means of this negative pressure, the leakage flow is aspirated from the annular conduit 25 into the return line 8 and delivered to the inlet of the low-pressure pump 2. As a result, unintended pumping during a zero pumping state is effectively prevented.

In the second embodiment of the fuel pump assembly 1 of the invention, described below in conjunction with FIGS. 5–8, the same reference numerals will be used for equivalent components.

Figure 5:
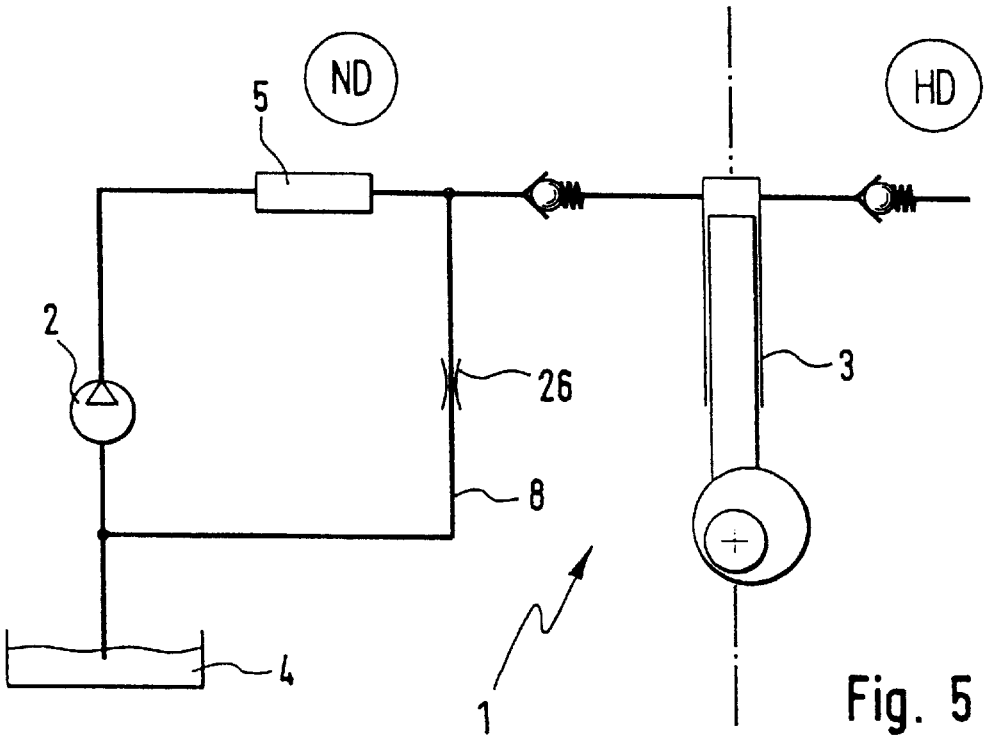
FIG. 5 is a schematic elevation view of a fuel pump assembly of the invention in a second embodiment.

The fuel pump assembly 1 shown in FIG. 5 has a throttle element 26, instead of a two-point switch element 9, in the fuel return line 8. Such a throttle element 26 is designed for the particular application, so that zero pumping is assured at all the necessary operating points. The throttle element 26 is shown in FIG. 6.

Figure 6:
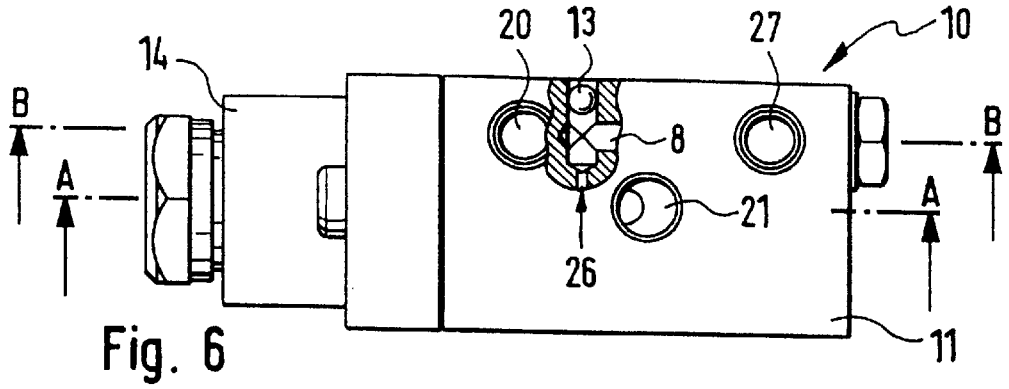
FIG. 6 partly in section, shows a metering unit assembly of the fuel pump assembly of the invention of FIG. 5.
Figure 7:
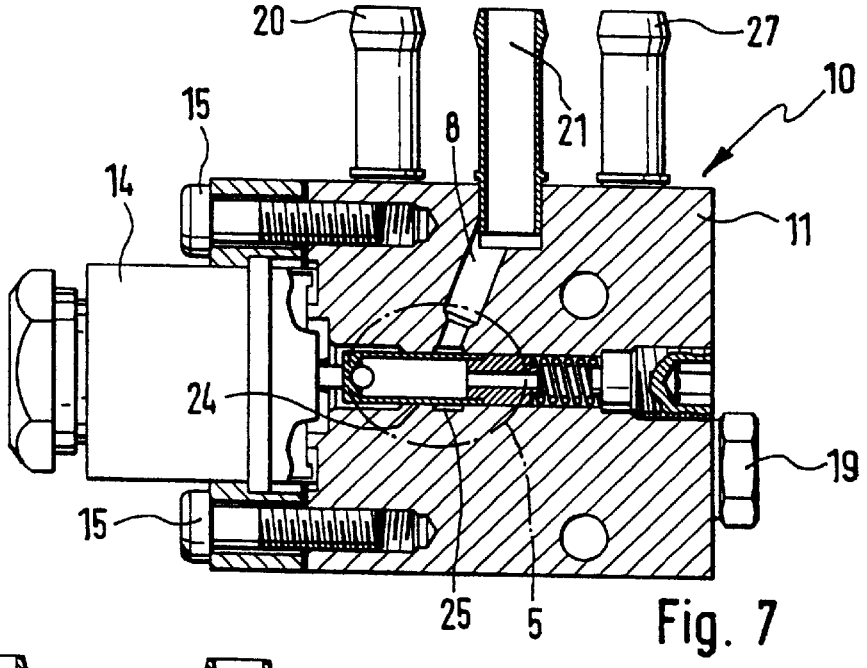
FIG. 7, in a sectional view taken along the line A—A, shows the metering unit assembly of FIG. 6.
Figure 8:
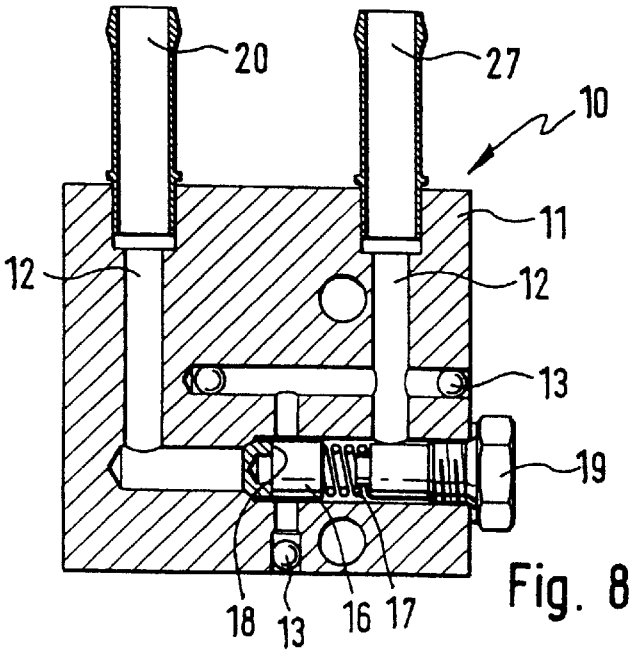
FIG. 8, in a sectional view taken along the line B—B, shows the metering unit assembly of FIG. 6.

In the metering unit assembly shown in FIGS. 6–8, the return opening and the overflow opening are embodied as a combined return overflow opening 27, which is connected to the inlet of the low-pressure pump 2.

The mode of operation of the fuel pump assembly 1 in its second embodiment differs from that of the fuel pump assembly 1 in its first embodiment in that a leakage flow is diverted via the return line 8 not only at one operating point (preferably, at zero pumping); instead, because of the use of the throttle element 26, leakage flows can be diverted at various operating points. The diversion of the leakage flows is again effected by means of the negative pressure that forms in the return line 8. By means of the negative pressure, the leakage flow is aspirated from the annular conduit 25 into the return line 8 and delivered to the inlet of the low-pressure pump 2.

The foregoing relates to preferred exemplary embodiments of the invention, it being understood that other variants and embodiments thereof are possible within the spirit and scope of the invention, the latter being defined by the appended claims.

We claim:

1. A fuel pump assembly (1), having a low-pressure region (ND) with at least one low-pressure pump (2) and a high-pressure region (HD) with at least one regulated-quantity high-pressure pump (3), which pumps a quantity of fuel required to compensate for a quantitative balance in the high-pressure region, the quantity of fuel regulation being effected via a metering unit (5) disposed between the low-pressure pump (2) and the high-pressure pump (3), wherein a pumping flow of the low-pressure pump (2) is greater than a pumping flow of the high-pressure pump (3); a fuel return line (8) branches off between the metering unit (5) and the high-pressure pump (3) and discharges into an inlet of the low-pressure pump (2); and a control element (9, 26) is disposed in the fuel return line (8).

2. The fuel pump assembly (1) according to claim 1, in which the control element is embodied as a switch element.

3. The fuel pump assembly (1) according to claim 2, in which the switch element is embodied as a two-point switch element (9).

4. The fuel pump assembly (1) according to claim 2, in which the control element is embodied as a throttle element (26).

5. The fuel pump assembly (1) according to claim 1, in which the fuel pump assembly (1) is used in internal combustion engines provided with direct injection.

6. The fuel pump assembly (1) according to claim 5, in which the direct injection operates by the common rail technique.

7. The fuel pump assembly (1) according to claim 1, in which the fuel pump assembly (1) is used in internal combustion engines of motor vehicles.

8. The fuel pump assembly (1) according to claim 1, in which an overflow line (6) branches off from an outlet of the low-pressure pump (2) and discharges into the inlet of the low-pressure pump (2), and that an overflow valve (7) is disposed in the overflow line (6).

9. The fuel pump assembly (1) according to claim 2, in which an overflow line (6) branches off from an outlet of the low-pressure pump (2) and discharges into the inlet of the low-pressure pump (2), and that an overflow valve (7) is disposed in the overflow line (6).

10. The fuel pump assembly (1) according to claim 3, in which an overflow line (6) branches off from an outlet of the low-pressure pump (2) and discharges into the inlet of the low-pressure pump (2), and that an overflow valve (7) is disposed in the overflow line (6).

11. The fuel pump assembly (1) according to claim 4, in which an overflow line (6) branches off from an outlet of the low-pressure pump (2) and discharges into the inlet of the low-pressure pump (2), and that an overflow valve (7) is disposed in the overflow line (6).

12. The fuel pump assembly (1) according to claim 8, in which the metering unit (5), the control element (9, 26) and the overflow valve (7) are combined into a metering unit assembly (10).

13. The fuel pump assembly (1) according to claim 9, in which the metering unit (5), the control element (9, 26) and the overflow valve (7) are combined into a metering unit assembly (10).

14. The fuel pump assembly (1) according to claim 10, in which the metering unit (5), the control element (9, 26) and the overflow valve (7) are combined into a metering unit assembly (10).

15. The fuel pump assembly (1) according to claim 11, in which the metering unit (5), the control element (9, 26) and the overflow valve (7) are combined into a metering unit assembly (10).

16. The fuel pump assembly (1) according to claim 12, in which the metering unit assembly (10) comprises a metal block (11), in which the metering unit (5), the control element (9, 26), the overflow valve (7), and connecting line conduits (12) are embodied as integral components.

17. The fuel pump assembly (1) according to claim 16, in which the connecting line conduits (12) are provided as bores in the metal block (11) that are closable with respect to outside of the metal block (11).

18. The fuel pump assembly (1) according to claim 12, in which the metering unit assembly (10) has an inlet opening (20) from the outlet of the low-pressure pump (2), an outlet opening (21) to the inlet of the high-pressure pump (3), a return opening (22) to the inlet of the low-pressure pump (2) and an overflow opening (23) to the inlet of the low-pressure pump (2).

19. The fuel pump assembly (1) according to claim 16, in which the metering unit assembly (10) has an inlet opening (20) from the outlet of the low-pressure pump (2), an outlet opening (21) to the inlet of the high-pressure pump (3), a return opening (22) to the inlet of the low-pressure pump (2), and an overflow opening (23) to the inlet of the low-pressure pump (2).

20. The fuel pump assembly (1) according to claim 17, in which the metering unit assembly (10) has an inlet opening (20) from the outlet of the low-pressure pump (2), an outlet opening (21) to the inlet of the high-pressure pump (3), a return opening (22) to the inlet of the low-pressure pump (2), and an overflow opening (23) to the inlet of the low-pressure pump (2).

21. The fuel pump assembly (1) according to claim 18, in which the return opening (22) and the overflow opening (23) are embodied as a combined return overflow opening (27).

22. The fuel pump assembly (1) according to claim 12, in which the metering unit (5) has a cylindrical hollow chamber in which a piston (24) is disposed so as to be displaceable along its longitudinal axis.

23. The fuel pump assembly (1) according to claim 16, in which the metering unit (5) has a cylindrical hollow chamber in which a piston (24) is disposed so as to be displaceable along its longitudinal axis.

24. The fuel pump assembly (1) according to claim 17, in which the metering unit (5) has a cylindrical hollow chamber in which a piston (24) is disposed so as to be displaceable along its longitudinal axis.

25. The fuel pump assembly (1) according to claim 18, in which the metering unit (5) has a cylindrical hollow chamber in which a piston (24) is disposed so as to be displaceable along its longitudinal axis.

26. The fuel pump assembly (1) according to claim 21, in which the metering unit (5) has a cylindrical hollow chamber in which a piston (24) is disposed so as to be displaceable along its longitudinal axis.

27. The fuel pump assembly (1) according to claim 22, in which the metering unit (5) has a proportional lifting magnet (14) for adjusting the metering unit (5).

28. The fuel pump assembly (1) according to claim 27, in which the piston (24) of the metering unit (5) is connected to an armature of the lifting magnet (14).

29. The fuel pump assembly (1) according to claim 27, in which the lifting magnet (14) is flanged to the metering unit assembly (10).

30. The fuel pump assembly (1) according to claim 28, in which the lifting magnet (14) is flanged to the metering unit assembly (10) .

31. The fuel pump assembly (1) according to claim 29, in which the lifting magnet (14) is secured to the metering unit assembly (10) by fastening screws (15).

32. The fuel pump assembly (1) according to claim 12, in which the metering unit assembly (10) is integrated with the low-pressure pump (2).

33. The fuel pump assembly (1) according to claim 16, in which the metering unit assembly (10) is integrated with the low-pressure pump (2).

34. The fuel pump assembly (1) according to claim 17, in which the metering unit assembly (10) is integrated with the low-pressure pump (2).

35. The fuel pump assembly (1) according to claim 18, in which the metering unit assembly (10) is integrated with the low-pressure pump (2).

36. The fuel pump assembly (1) according to claim 21, in which the metering unit assembly (10) is integrated with the low-pressure pump (2).

37. The fuel pump assembly (1) according to claim 22, in which the metering unit assembly (10) is integrated with the low-pressure pump (2).

38. The fuel pump assembly (1) according to claim 8, in which the overflow valve (7) has a valve cone (16), which is pressed against a valve seat (18) by means of a compression spring (17), and the tension of the compression spring is adjustable from outside the metering unit assembly (10) by means of an adjusting screw (9) that acts axially on the compression spring (17).

39. The fuel pump assembly (1) according to claim 12, in which the overflow valve (7) has a valve cone (16), which is pressed against a valve seat (18) by means of a compression spring (17), and the tension of the compression spring is adjustable from outside the metering unit assembly (10) by means of an adjusting screw (9) that acts axially on the compression spring (17).

40. The fuel pump assembly (1) according to claim 16, in which the overflow valve (7) has a valve cone (16), which is pressed against a valve seat (18) by means of a compression spring (17), and the tension of the compression spring is adjustable from outside the metering unit assembly (10) by means of an adjusting screw (9) that acts axially on the compression spring (17).

* * * * *